United States Patent [19]

Walbröhl

[11] 4,305,684

[45] Dec. 15, 1981

[54] METHOD OF AND APPARATUS FOR HORIZONTALLY AND VERTICALLY GUIDING A CUTTER DRIVE SHIELD

[76] Inventor: Heinz T. Walbröhl, Nordstrasse 73, Bon 1, Fed. Rep. of Germany, 5300

[21] Appl. No.: 943,980

[22] Filed: Sep. 20, 1978

[30] Foreign Application Priority Data

Sep. 20, 1977 [DE] Fed. Rep. of Germany ..... 2742332

[51] Int. Cl.[3] ..... E01G 3/02

[52] U.S. Cl. ..... 405/145; 405/141

[58] Field of Search ..... 405/138–151; 299/31–33

[56] References Cited

U.S. PATENT DOCUMENTS

| | | | |
|---|---|---|---|
| 675,355 | 5/1901 | MacHarg | 405/145 X |
| 1,948,707 | 2/1934 | Gilman | 405/143 X |
| 3,926,005 | 12/1975 | Foik | 405/143 |
| 3,998,066 | 12/1976 | Semenov et al. | 405/141 |
| 4,010,618 | 3/1977 | Walker et al. | 405/296 X |
| 4,063,425 | 12/1977 | Jutt et al. | 405/145 |
| 4,099,388 | 7/1978 | Husemann et al. | 405/141 |

FOREIGN PATENT DOCUMENTS

| | | | |
|---|---|---|---|
| 617994 | 8/1935 | Fed. Rep. of Germany | 405/141 |
| 621064 | 11/1935 | Fed. Rep. of Germany | 405/141 |
| 2500271 | 7/1976 | Fed. Rep. of Germany | 405/141 |

*Primary Examiner*—Dennis L. Taylor

*Attorney, Agent, or Firm*—Browdy and Neimark

[57] ABSTRACT

A method of horizontally and vertically guiding a cutter advance mechanism involves adjusting and fixing each individual cutter plank of a plurality of cutter planks for a radial change of direction with respect to the apparatus and by guiding the individual cutter planks in the circumferential direction during its advance. The individual planks are provided with a tip which is pivotally attached to its front portion. Wedge surfaces which may be deployed are provided in the vicinities of the front and rear ends of the planks so as to engage the support frame. Two additional wedge surfaces are provided at side surfaces of the central plank, others of the cutter planks, are provided with a further wedge surface at respective sides thereof facing away from the central plank.

14 Claims, 6 Drawing Figures

METHOD OF AND APPARATUS FOR HORIZONTALLY AND VERTICALLY GUIDING A CUTTER DRIVE SHIELD

BACKGROUND OF THE INVENTION

The invention relates to a method of and an apparatus for horizontal and vertical guidance of cutter drive shields in open as well as closed spaces by advancing individual cutters of a cutter drive shield according to the predetermined sequence.

There is known a method for the horizontal and vertical guidance of cutter drive shields in closed, as well as open, spaces, whose construction and operation is to be described below for the purpose of illustrating the possibilities for guidance.

The known cutter drive shield consists essentially of a support frame, a drive or advance frame and of cutter planks comprising leading and trailing sections, the latter of which serve temporarily as a lining of the tunnel wall and are supported on the support frame.

In order to drive the shield forward, individual cutters are locked to the drive frame. Hydraulically actuated drive rams which are effective as between the support frame and the drive frame advance portions of the cutter shield which requires only relatively small forces. The static friction between the remainder of the cutter shield and the earth resting thereon constitutes an abutment of the hydraulically advancing cutter shield elements which thus do not exert reactive forces against the permanent tunnel lining during their advance.

All cutter planks being advanced, the drive frame, to which all cutters have been locked, advances the support frame by the length of the stroke of the hydraulic ram, and a new working cycle may begin.

The region of the trailing cutter section constitutes the outer casing for introducing the lining concrete, whereby the advancement of the drive shield may be pursued continuously independently of the setting time of the introduced lining concrete. Once a region of concrete is exposed in the rear follower, the interior form is pulled forward and the next region is concreted.

The guidance of the cutter drive shield is possible due to the reaction forces which occur when individual planks at a predetermined side of the shield are advanced. For example, if the cutter drive shield is to be driven in a horizontal plane, for example in a right turn, several cutters are simultaneously advanced in the direction of motion on the right side. The reaction forces which thus occur tilt the support frame, thereby introducing the curved drive motion. Subsequently, the direction is stabilized by the advance of individual cutters on the left side.

In corresponding manner, it is possible to perform a vertical guidance. If the known cutter drive shield is to be guided downwardly, a few side cutters which are located at the bottom of the cutter shield periphery at the left and right sides are simultaneously advanced or else the bottom cutters are advanced. The remaining lateral cutters are subsequently advanced in pairs, i.e., individually on each side. If the cutter drive shield is to be guided upwardly, a few lateral cutters which are located on the left and right sides at the top of the circumference of the cutter drive shield are simultaneously advanced. In this manner, the support frame is raised somewhat. This upwardly directed position is stabilized by individual advance of the bottom cutters.

Accordingly, the known method of maneuvering [Wilhelm Stüber: Westfalia- REPORTS, Dec. 1976, item 5.2] in curves is based on a tilting of the support frame which occurs when the sum of the forward driving forces of those cutters which are simultaneously advanced on one side is greater than the friction which exists between the support frame and the cutter.

It is a decisive disadvantage of the known method for controlling the shield advancement direction that the force conditions which lead to a tilting of the frame are not defined and depend on a multitude of factors, such as the specific ground friction, the top loading, the loosening, etc. Due to the undefined force conditions and especially because of the compulsive forces indirectly exerted on the cutter drive shield due to the tilting of the frame in the direction of intended curve, an exact guidance is possible only within limits and the guidance operation must be continuously controlled during the advance of the cutter drive shield and may have to be corrected. Furthermore, for example during the driving of a right-hand curve, as seen in the direction of advance, the tilting of the frame causes a reduction of the support for the cutters on the left side. For this reason, these cutters move inwardly during their advance which generates additional hollow spaces or loosening. Furthermore, generally only curves having very large radii may be evacuated in this fashion.

SUMMARY OF THE INVENTION

It is the principal object of the invention to provide a method of guiding a cutter drive shield which makes possible in relatively simple manner an exact curve control of the cutter drive shield in the vertical as well as the horizontal direction, even for small radii of curvature, wherein the force conditions are defined and no tilting of the support frame takes place.

This basic problem of the present invention is solved in that each individual cutter plank of the cutter drive shield may be adjusted and fixed in position in upwardly or downwardly directed angles with respect to the radial change of direction with respect to the cutter shield and wherein each and every individual cutter plank is guided in the circumferential direction of the cutter shield during its advance by at least one of the immediately adjacent cutter planks.

Thus according to the invention a driving of a curve is not indirectly performed by indirectly exerting coercive forces on the shield but rather by controlling the cutter shield directly and immediately. In this manner, a predetermined route control can be performed more easily by comparison with the known method of guidance in curves. Thus, overall control of the advance can be performed in less time and at reduced cost. A correction of the direction of advance needs to be performed in the rarest cases.

The cutter drive shield which is a drive shield divided into individual and relatively movable planks naturally required mutual coercive guidance of the cutters. In practice therefore, the individual cutter planks have locks similar to a bulkhead, so that a longitudinal guidance of the individual cutter planks can be assured during their advance. On the one hand, the desired parallel guidance of individual cutter planks during the advance requires a tight guidance on the lock, yet on the other hand the required relative mobility of the cutter in the direction of the circumference of the cutter drive shield requires some clearance or backlash in the lock. Inasmuch as it is not possible to realize these two requirements in a practical construction, compromises have had to be made in practice in one or the other directions.

By the use of the conception according to the invention, i.e., the mutual guidance of individual cutter planks, the cutter lock no longer has any guidance function. The only remaining task for the cutter lock is to prevent a falling in of the earth by the space between the individual cutters. For this reason, the overlapping of the individual cutter planks (the clearance in the lock) can be chosen to be large enough to permit a relatively large relative motion of the individual cutter planks in the circumferential direction of the cutter drive shield, such as may be required during the driving of curves.

An advantageous method for the guidance in curves is characterized in that each working cycle of an advance stroke of all of the cutter planks is initiated even in this case by the top cutter plank. For this reason, the stabilizing conditions of the cutter drive shield are especially favorable during the driving of curves.

Advantageously, the upward or downward angling takes place by adjusting a radially pivotable cutter tip. The up or down angling may also take place by adjusting the sliding surface of the cutter plank with respect to the support frame.

A particularly advantageous method provides that any advancing cutter plank is steplessly guided in the direction of the circumference of the shield by an adjustable mechanism disposed between the advancing cutter plank and its neighboring cutter plank.

An apparatus which operates according to the method of the present invention is characterized in that the cutter plank includes a cutter tip coupled thereto which has substantially the shape of a V or hook (1) which is pivotably attached radially or cardanically at the front of the cutter plank and whose one leg envelopes the front end of the cutter plank whereas the external surface of the second leg lies in the plane of the outer surface of the cutter plank corresponding to a straight line advance of the cutter plank and may be angled up or down out of this plane for changing the radial direction of the cutter plank.

The cutter tip may be steplessly adjusted especially with the aid of hydraulic presses or rams.

A further aspect of the invention provides that the displaceable cutter plank which is supported on the support frame has steplessly adjustable wedge surfaces in the region of the front and rear ends of its sliding surface. The adjustment of the wedge surfaces can be suitably provided for by countersunk adjustment screws, especially socket head screws within the wedge surfaces.

However, the adjustment of the wedge surfaces may also take place preferably by means of a hydraulic adjusting device.

A further aspect of the invention provided that as seen in the circumferential direction of the cutter shield wedge surfaces are formed on both sides in the region of the cutter tip at one of the central cutter planks, especially at the top cutter plank and that, of the substantially remaining cutter planks of the cutter shield, each has a corresponding lateral wedge surface which is disposed on that side surface thereof which is remote from the central cutter plank, and that each side surface of the remaining cutter planks which faces the central cutter plank can be brought into engagement with the opposite lying wedge surface of the neighboring cutter plank for the purpose of (advance) guidance of the cutter shield in the direction of the circumference, and that there is provided a pressure controlled adjusting mechanism for the (rear following) guidance of the cutter shield in the circumferential direction between each neighboring side surfaces of two cutter planks. The wedge surfaces which extend in the circumferential direction furthermore, permit a fine control of the mutual position of all cutters in a cutter shield each of which is aligned practically without clearance with respect to the already advanced cutter planks at the end of its advanced motion. Therefore, it is simple to keep order within the cutter shield. Furthermore, there is a constant transmission of force to the neighboring cutter planks which leads to an optimum support for each cutter plank in the cutter shield.

The pressure controlled adjusting mechanism may include in particular a hydraulic press or a fluid pressure controlled wear resistant adjustment bar which is disposed at the side of each cutter plank and which may be brought into engagement with the neighboring side surface of a cutter plank.

Finally, a preferred further aspect provides that the cutter plank and the cutter tail are joined by a pivotable hinge. This ensures that no coercive forces are transmitted to the cutter during the driving of curves or directional corrections and that a certain amount of bending is possible.

BRIEF DESCRIPTION OF THE DRAWING

The invention is described in more detail below with the aid of an exemplary embodiment, reference being made to the accompanying drawings.

DETAILED DESCRIPTION OF THE PREFERRED EMBODIMENT

Figures 1, 2:
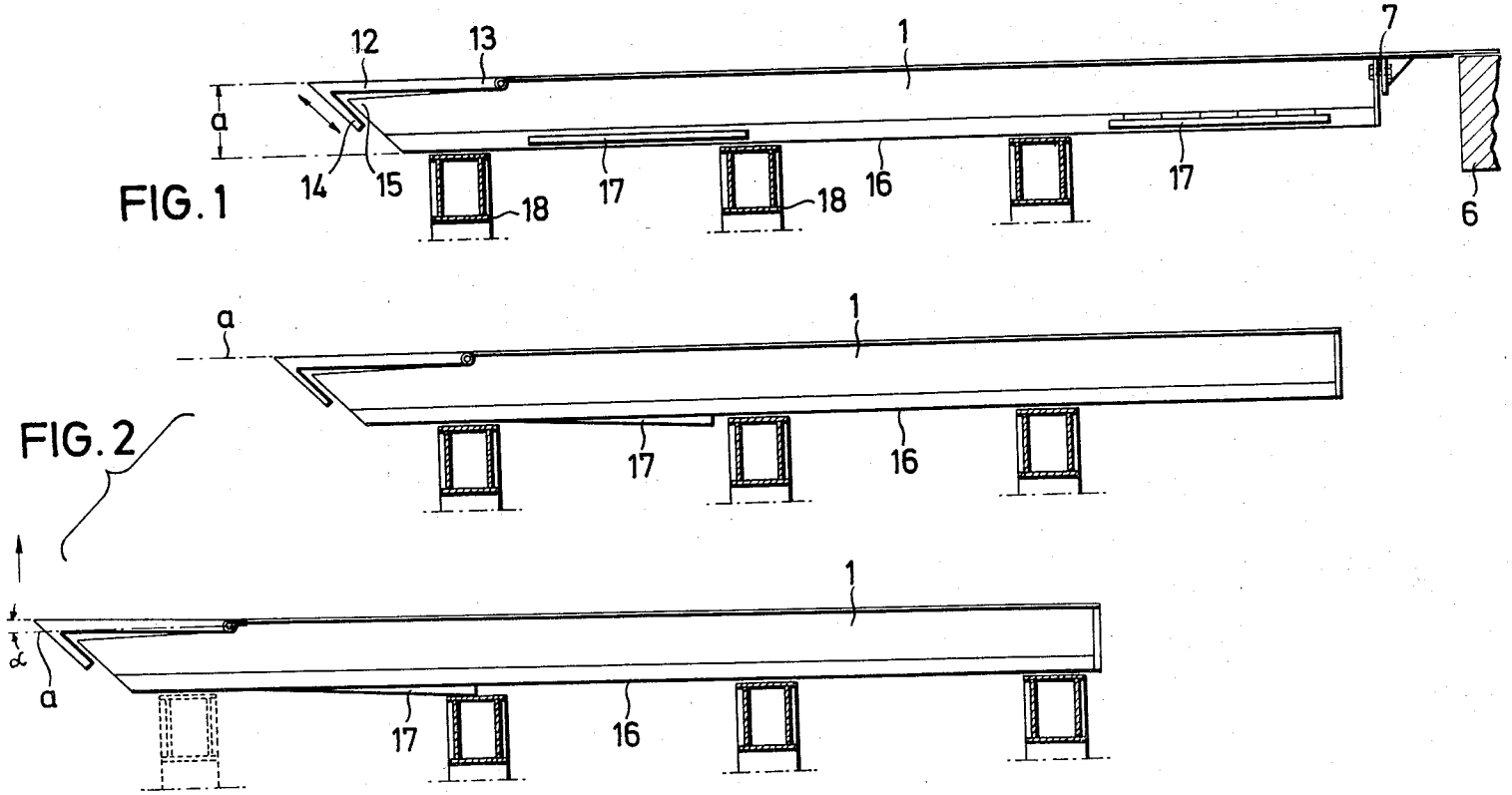
FIG. 1 is a somewhat diagrammatic illustration of a top cutter plank of a cutter drive shield, in longitudinal section, with a pivotable cutter tip and angularly extendable wedge surfaces at the bottom, the cutter being adjusted to move along a straight-ahead path.
FIG. 2 shows two longitudinal section views of the top cutter plank according to FIG. 1, adjusted for an upward path and illustrated before and after a working stroke.

In FIG. 1, there is shown in longitudinal section the topmost cutter plank 1, of a cutter shield, the so-called ridge cutter plank 1, which is slidably supported on a support frame 18 that is formed of curved traverse struts corresponding to the cross section of a tunnel. The ridge cutter plank 1 has a substantially V-shaped cutter tip 12 at its front end one leg 13 of which is joined radially pivotably near the front portion of the cutter plank 1 whereas the other leg 14 envelops the front end 15 of the cutter plank 1. The external surface of the pivoted leg 13, as shown in FIG. 1, lies in the plane of the outer surface of the cutter plank 1 so that the pivotal cutter tip 12 is adjusted for a straight-ahead motion. The position of the cutter tip 12 is fixed for example with the aid of a hydraulic press 30, winch or the like. The bottom sliding surface 16 of the ridge cutter plank 1 has bolted wedge surfaces 17 near its front and rear portions which according to FIG. 1 are disposed beneath the sliding surface 16, these wedge surfaces 17 being adjusted in this position for a straight-ahead motion. Thus, the ridge cutter plank 1 which drives toward the left according to FIG. 1 is tangentially movable on its sliding surface 16 on the top side of the support frame 18 without permitting the wedge surfaces 17 to come into engagement with the support frame 18. The cutting edge of the pivotable cutter tip 12 accordingly moves on a horizontal line a and parallel to the sliding surface 16 of the ridge cutter plank 1 during a working cycle. The ridge cutter plank 1 and the cutter tail 6 which may be a trailing cutter plank are joined by a hinge 7. This hinge insures that no coercive forces are carried into the cutter plank during the driving of curves or while the direction is corrected and a certain amount of bending is thereby made possible.

In FIG. 2, the ridge cutter plank 1 of FIG. 1 is adjusted for an upward motion and is illustrated before and after a working cycle. The adjustment for an upward motion takes place in that the pivotable cutter tip 12 is moved upwardly in the clockwise sense by a relatively small angle as shown in the drawing, the movement for example being effected by a hydraulic press 30 of the like and the wedge surfaces 17 which were recessed in the bottom of the front portion of the cutter plank 1 as shown in FIG. 1 are extended so as to protrude from the plane of the sliding surface 16 and engage the support frame 18 during a forward stroke so that the ridge cutter plank 1 is angled upwardly with respect to the horizontal line a by total angle $\alpha$. Only one of wedge surfaces 17 associated with the front portion of the cutter 1 is visible in FIG. 2.

Figure 3:
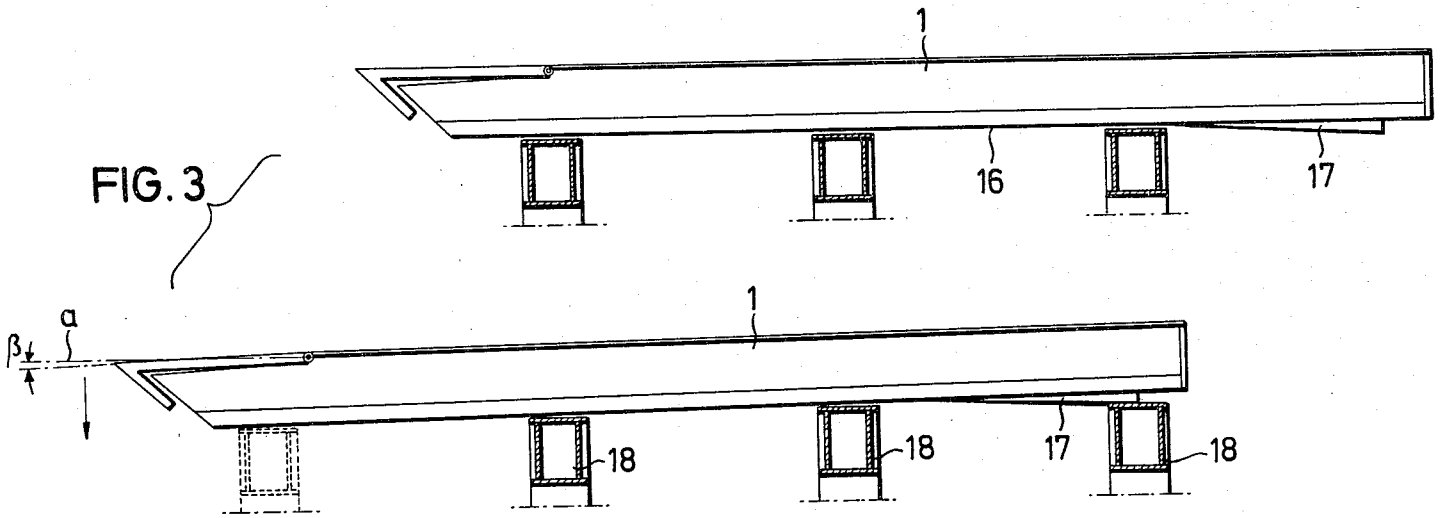
FIG. 3 shows two longitudinal section views of the top cutter plank according to FIG. 1 adjusted for a downward path and shown before and after a working stroke.

In FIG. 3 which corresponds substantially to FIG. 2, the ridge cutter plank 1 is adjusted in a corresponding manner for a downward motion. The pivotable cutter tip 12 is angled downwardly and the wedge surfaces 17 in the rear portion of the sliding surface, only one being visible in FIG. 3, are moved out whereas the wedge surfaces 17 in the front portion of the sliding surface remain recessed so that the ridge cutter plank 1 is angled downwardly with respect to the horizontal line a by an angle $\beta$ during a forward stroke.

The result of the upward angling at the angle $\alpha$ according to FIG. 2 or the downward angling at the angle $\beta$ according to FIG. 3 of the ridge cutter plank 1 is that it may be advanced into the ground with a variable but exactly determinable change of direction and wherein the change of direction does not result in coercive forces on the cutter tail 6, shown in FIG. 1, due to the interposed pivot joint 7.

Figure 4:
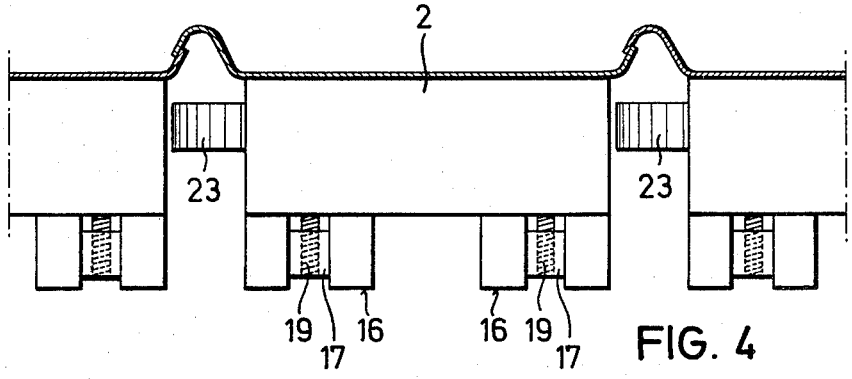
FIG. 4 is a cross-sectional view of a cutter shield, showing the positions of the lateral and vertical wedge surfaces.
Figure 5:
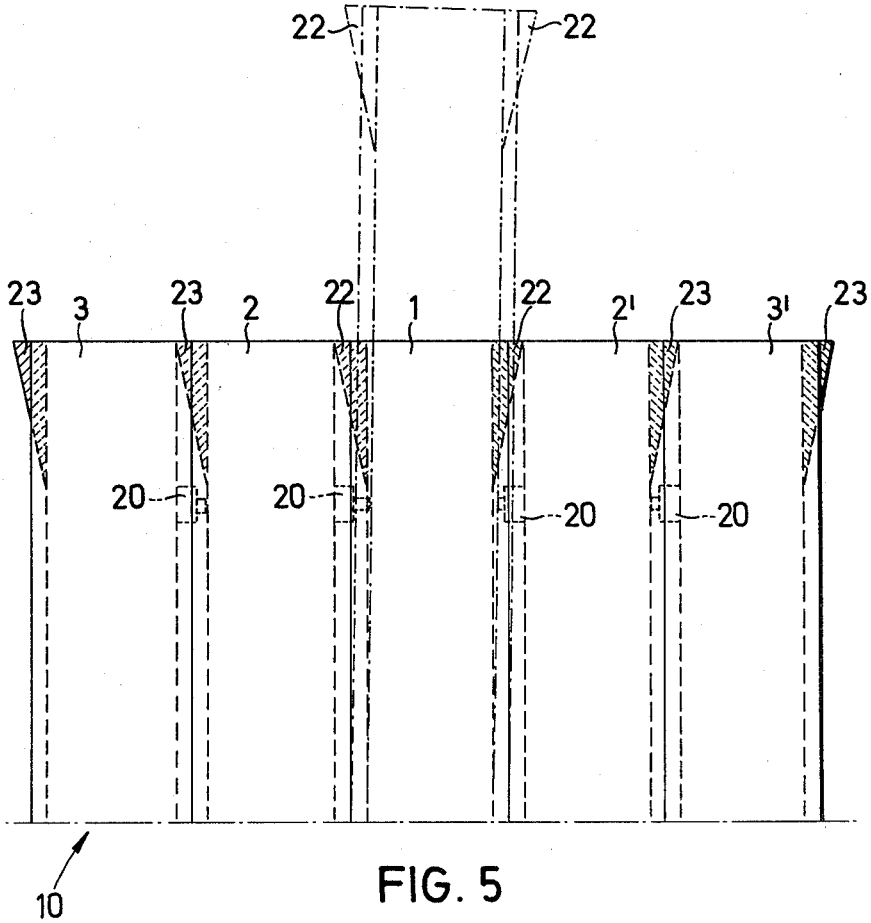
FIG. 5 is a top view of a portion of the cutter shield, the top cutter plank being shown centrally located.

The cross sectional region of a cutter drive shield illustrated in FIG. 4 shows a cutter plank 2 disposed between the ridge cutter plank 1 and a side cutter plank 3, which can also be seen in plan view in FIG. 5. In FIG. 4 the cross sectional form of the sliding surface 16 and the recessible wedge surfaces 17 can be seen. The movement of the wedge surfaces 17 is effected by adjustment of socket head screws 19 which extend into threaded bores within the cutter planks 1, 2, and 3.

As may be further seen from FIG. 4, one of the side surfaces of the cutter plank 2 has a further wedge surface 23, the significance of which will be described in connection with FIGS. 5 and 6. The ridge cutter plank 1 is provided with two additional wedge surfaces 22, as best shown in FIG. 5.

Figure 6:
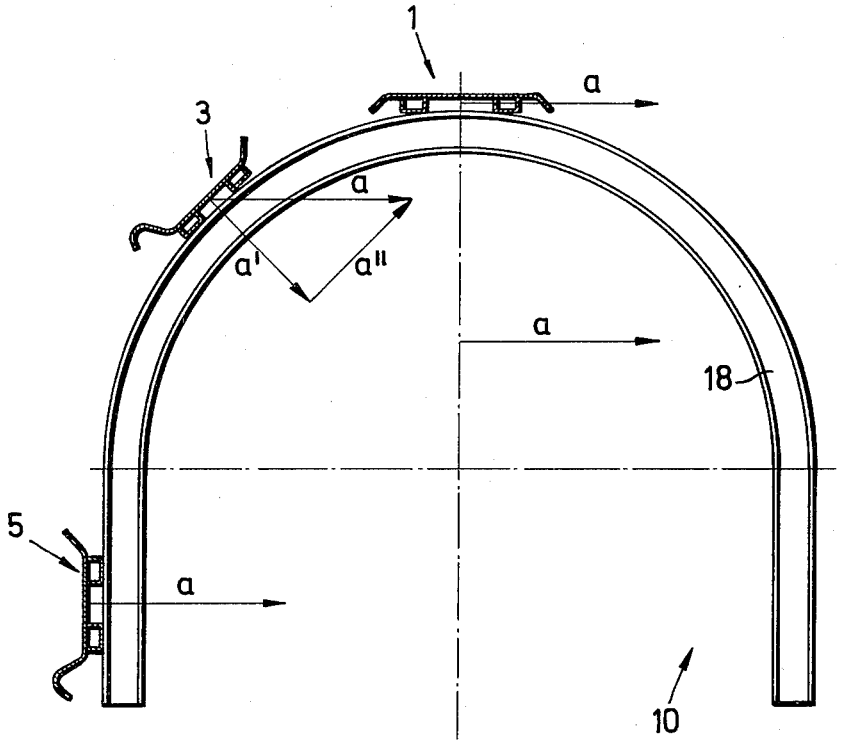
FIG. 6 is a schematic cross-sectional view through the upper cutter shield in which the relative motions of individual cutter planks are shown vectorially during a right turn motion.

FIG. 6 illustrates in schematic cross section a subterranean space including a support frame 18, a ridge cutter plank 1, a lateral cutter plank 5 and an intermediate cutter plank 3 configured as lateral cutter 2. The motions of individual cutter planks in a right turn are illustrated. Let the displacement vector a be assigned to the radius of curvature associated with a right turn. Whereas the cutter tips of the cutter plank 1 and the lateral cutter plank 5 are directly displaced by the vector a, the motion of the intermediate cutter 2 is composed of two motions which are added vectorially to result in the displacement vector. The vectorial composition of two perpendicular motions is required because the support conditions of the cutter planks do not permit (oblique) bending in the direction of the vector a. With the exception of the cutter planks 1 and the lateral cutter planks 5, all other cutter planks in the cross section shown in FIG. 6 must be displaced firstly in the direction of the radius of curvature a′ and secondly in the direction a″ of the circumference of the support frame.

The guidance of the lateral cutter plank 5 in the direction a as well as the guidance of the intermediate cutter plank 3 in the direction a′ takes place in the same manner as has been described previously for a downward motion according to FIG. 3 and with respect to the ridge cutter plank 1.

The guidance of the ridge cutter plank 1 in the direction a as well as the guidance of the intermediate cutter plank 3 in the direction of the vector a″ according to FIG. 6 means a displacement of the corresponding cutter plank on the circumference of the support frame 18. For the purpose of the related circumferential guidance, the ridge cutter plank 1 has the wedge surfaces 22 on both sides in the vicinity of the cutter tip, as shown in FIGS. 4 and 5, while of the remaining cutter planks 2 and 2′, 3 and 3′ of the cutter shield 10 according to FIG. 5, each has one corresponding lateral wedge surface 23 which is located at the side surface facing away from the central ridge cutter plank 1. The side surface of the remaining cutter plank 2 and 2′, 3 and 3′, which faces the central ridge cutter plank 1 may be brought into engagement with the opposite wedge surface of the neighboring cutter plank for the purpose of guiding the advance of the cutter shield 10 in the circumferential direction. Furthermore, hydraulic presses or bars 35 constituting adjusting mechanisms 20 which can be expanded by pressurized media are located between the individual cutter planks.

In operation and in the closed construction mode the ridge cutter plank 1 is advanced first. At the moment of initiation of the advance, the cutter plank obtains a relative freedom of motion with respect to the neighboring cutter planks and thus is susceptible to be displaced in the desired direction on the circumference of the support frame 18 by hydraulic presses or expansible bars which are coupled permanently or temporarily with the cutter plank 2 and which are located between the cutter planks 1 and 2.

The next step is, for example, the advance of the cutter plank 2 according to FIG. 5 in order to drive, for example, a right hand curve, wherein the cutter tip is angled by an amount with respect to the tunnel axis which corresponds to the position of the cutter plank. At the same time, the adjustable wedge surfaces according to FIG. 3 which are located between the sliding surfaces 16 of the cutter are extended in the rear part of the cutter plank. This step caused the cutter tip to be displaced during the advance by the vector a′ corresponding to the position of the cutter plank. The displacement of the cutter plank by the vector a″ on the circumference of the support frame 18 takes place by actuation of the pressure controlled adjusting mechanism 20 between the cutter planks 2 and 3 or by suitable expanding bars. In the same manner, all cutter planks of the left side in FIG. 5 as seen in the direction of advance are correspondingly displaced.

In analogy to the above explanations, the tip of the cutter plank 2′ is angled upwardly with respect to the tunnel axis during its advance as shown in FIG. 2. At the same time, the adjustable wedge surfaces 17 in the front part of the cutter plank between the sliding surfaces are extended or lowered as in FIG. 2 so that the cutter tip moves outwardly by the vector a′ during its advance. At the same time the cutter plank is displaced by the vector a″ by the engagement of the wedge of the cutter plank 1 with the cutter arch.

The guidance according to the invention thus permits an exact guidance which is fixable in position for each individual cutter plank both in the radial as well as in the circumferential direction with respect to a tunnel arch, and according to the invention, the individual cutter planks are mutually guided or controlled by laterally disposed wedge surfaces so that the so-called cutter lock no longer has any guidance function.

It is to be understood that the foregoing description, which relates to an exemplary embodiment, has been set out by way of illustration, not limitation. Numerous other embodiments and variants are possible without departing from the scope and spirit of the invention, its scope being defined by the appended claims.

What is claimed is:

1. In an apparatus for horizontally and vertically guiding a cutter plank drive shield in construction, the apparatus including a plurality of cutter planks, the improvement comprising a cutter tip coupled on at least one of said cutter planks, said cutter tip having two legs and being substantially the form of a V or hook (7) which is pivotally attached to a front portion of said at least one cutter plank, radially or cardanically and a first one of said legs envelop a front end of this cutter plank and outer surface of a second of said legs lying in the plane of an outer surface of this cutter plank and corresponding to a straightahead advance of this cutter plank, said tip being angled upwardly and downwardly from said plane for a radial change of direction of this cutter plank, and wherein at least one of said cutter planks is a central cutter plank as seen in the circumferential direction of the apparatus and includes wedge surfaces at both sides thereof in the region of its said cutter tip, remaining ones of said cutter planks of the apparatus each having a corresponding lateral wedge surface which is located at that side thereof facing away from said central cutter plank, these side surfaces of said remaining cutter planks which face toward said central cutter plank being engageable with an opposing wedge surface of a neighboring one of said cutter planks for guiding the apparatus in the circumferential direction.

2. An apparatus according to claim 1, wherein said pressure controlled adjustment means comprise hydraulic press means.

3. An apparatus according to claim 1, wherein said adjustment means comprise a respective fluid pressure controlled, wear-resistant adjustment bar which is disposed at a side of each of said cutter plank and which may be brought into engagement with neighboring side surfaces of a given cutter plank.

4. In an apparatus for horizontally and vertically guiding of a cutter plank drive shield, the apparatus having a plurality of cutter planks, the improvement wherein at least one of said cutter planks which is slidably displaceable and which is supported on a support frame has wedge surfaces in vicinities of its front and rear ends of its surface which slides over said support frame and means for deploying said wedge surfaces with respect to said support frame, and wherein at least one of said cutter planks is a central cutter plank as seen in the circumferential direction of the apparatus and includes wedge surfaces at both sides thereof in the region of its cutter tip, remaining ones of said cutter planks of the apparatus each having a corresponding lateral wedge which is located at that side surface thereof facing away from said central cutter plank, these side surfaces of said remaining cutter planks which face toward said central cutter plank being engageable with an opposing wedge surface of a neighboring one of said cutter planks for guiding the apparatus in the circumferential direction, and including pressure controlled adjustment means between adjacent lateral surfaces of adjacent ones of said cutter planks for guiding the apparatus in the circumferential direction.

5. An apparatus according to claim 4, wherein said pressure controlled adjustment means comprise hydraulic press means.

6. An apparatus according to claim 4, wherein said adjustment means comprise a respective fluid pressure controlled, wear-resistant adjustment bar which is disposed at aside of each of said cutter planks and which may be brought into engagement with neighboring side surfaces of a given cutter plank.

7. A method for guidance of driving apparatus of a cutter shield for use both in closed as well as open construction in which at least onto some of individually, in a predetermined sequence, forwardly driven cutter planks supported on a support frame and having tips, during their advancing motion, radially directed forces are exerted altering the direction of the longitudinal axis of said cutter planks, characterized in that for driving along a curve individual ones of said cutter planks, in dependence upon intended alteration of direction are also simultaneously displaced in direction of the cutter drive shield over adjusting mechanisms (20; 22; 23) arranged respectively between each said cutter plank and at least one other of said cutter planks (2 or 2″; 1 or 3) directly neighbouring it, so that onto each said cutter plank during its advancing motion a force is exerted composed of one radial component and one component acting in circumferential direction, each said cutter tip being dislocated transversally with respect to its former direction of advancement by the same distance in the direction of the curve to be driven, whereby for the cutter planks arranged at the inside and the outside of the curve the component acting in circumferential direction and for the cutter planks arranged by an angle of 90° against these the radial component is chosen to be substantially zero.

8. A method according to claim 7, characterized in that each working cycle of an advancing stroke of all cutter planks (10) is introduced by a ridge cutter plank.

9. A method to claim 7 or 8, characterized in that an advancing one of said cutter planks (1) is guided steplessly variable in direction on the circumference of the cutter drive shield by an adjusting mechanism (20) disposed between said one of the cutter planks and at least one neighboring one of said cutter planks.

10. A method according to claim 7 or 8, characterized in that upward or downard angling takes place by adjusting a radially pivotable cutter tip (12).

11. A method according to claim 7 or 8, characterized in that upward or downward angling takes place by adjusting of a sliding surface (16) of at least one of said cutter planks with respect to the support frame (18).

12. In an apparatus for horizontally and vertically guiding a cutter plank drive shield, the apparatus having a support frame, a plurality of forwardly driven cutter planks supported on the support frame and having tips, and means for radially acting upon the cutter planks, which means are arranged in a front portion of the apparatus, the improvement wherein at least one of said cutter planks (1) in vicinity of a rear end of its sliding surface (16) has wedge surfaces (17) steplessly moveable against said support frame and, seen in circumferential direction of said cutter drive shield, on a middle one of said cutter planks, in vicinity of its cutter tip (15) wedge surfaces (22) are formed on both sides, remaining ones of said cutter planks (2, 2', 3, 3') of said cutter drive shield (10) each have a corresponding lateral wedge surface (23) which is arranged on a side surface facing away from said middle cutter plank (1), a respective side surface of said remaining cutter planks facing said middle cutter plank (1), for the purpose of guidance of said cutter drive shield (10) in a circumferential direction, are engageable with an opposite said wedge surface of neighboring ones of said cutter planks and a pressure controlled adjusting mechanism (20) is provided for rear guidance of said cutter drive shield in circumferential direction, between neighboring side surfaces of adjacent ones of cutter planks.

13. An improved apparatus according to claim 12, wherein said pressure controlled adjusting mechanism (20) consists of a hydraulic press.

14. An improved apparatus according to claim 12, wherein said adjusting mechanism (20) includes a fluid pressure controlled wear resistant adjustment bar which is disposed at the side of each said cutter plank and which can be brought into engagement with a neighboring side surface of a respective one of said cutter planks.

* * * * *